US008210365B2

(12) United States Patent
Van Wyk

(10) Patent No.: US 8,210,365 B2
(45) Date of Patent: Jul. 3, 2012

(54) MOTORCYCLE ACCESSORY RACK

(76) Inventor: Loren D. Van Wyk, Pella, IA (US)

( * ) Notice: Subject to any disclaimer, the term of this patent is extended or adjusted under 35 U.S.C. 154(b) by 78 days.

(21) Appl. No.: 12/283,343

(22) Filed: Sep. 11, 2008

(65) Prior Publication Data

US 2010/0059465 A1 Mar. 11, 2010

(51) Int. Cl.
*A47F 7/00* (2006.01)

(52) U.S. Cl. ..... 211/85.7; 211/87.01; 211/85.3; 296/78.1

(58) Field of Classification Search ..... 211/85.7, 211/85.3, 90.01–90.04, 30, 32, 183, 106, 211/181.1, 13.1, 189, 41.14, 175, 87.01; D6/553, 567, 572; 296/78.1, 96.21; 248/240
See application file for complete search history.

(56) References Cited

U.S. PATENT DOCUMENTS

| | | | | | |
|---|---|---|---|---|---|
| 1,171,198 | A | * | 2/1916 | Hellberg | 248/223.21 |
| 1,654,341 | A | * | 12/1927 | Mendiolagoitia | 211/99 |
| 1,962,205 | A | * | 6/1934 | Murray | 211/104 |
| 2,091,599 | A | * | 8/1937 | Larson et al. | 224/29.5 |
| 2,482,003 | A | * | 9/1949 | Kauffman | 211/85.3 |
| 2,525,259 | A | * | 10/1950 | Fenzl | 211/85.3 |
| 2,633,998 | A | * | 4/1953 | Derman et al. | 211/104 |
| 2,647,641 | A | * | 8/1953 | Tritt | 211/88.04 |
| 2,827,555 | A | * | 3/1958 | Woolley | 362/132 |
| 3,907,119 | A | | 9/1975 | Franz | |
| 3,915,308 | A | | 10/1975 | Ratzloff | |
| 4,854,456 | A | | 8/1989 | Lee | |
| 4,936,467 | A | * | 6/1990 | Bobeczko | 211/14 |
| D309,998 | S | | 8/1990 | Sumrell | |
| 5,228,578 | A | | 7/1993 | Wu | |
| 5,294,006 | A | | 3/1994 | Deschino | |
| 5,584,400 | A | * | 12/1996 | Feinbloom | 211/85.1 |
| 5,711,435 | A | * | 1/1998 | Morison et al. | 211/90.01 |
| 5,871,105 | A | * | 2/1999 | Whitehead et al. | 211/14 |
| 6,112,909 | A | * | 9/2000 | Moseley | 211/32 |
| D431,954 | S | | 10/2000 | White | |
| D439,465 | S | | 3/2001 | Mok | |
| 6,257,425 | B1 | * | 7/2001 | Liu | 211/90.01 |
| D450,199 | S | | 11/2001 | White | |
| 6,561,364 | B1 | * | 5/2003 | Brunsden | 211/90.01 |
| 6,679,537 | B1 | * | 1/2004 | Putnam, Jr. | 296/78.1 |
| 6,808,219 | B2 | | 10/2004 | Barber | |
| 6,820,756 | B2 | * | 11/2004 | Garza | 211/87.01 |
| 6,892,992 | B2 | * | 5/2005 | Donahue | 248/201 |
| 7,150,364 | B2 | * | 12/2006 | Jablow et al. | 211/153 |
| 7,168,577 | B1 | * | 1/2007 | Moseley | 211/32 |
| 7,490,803 | B1 | * | 2/2009 | Graves | 248/251 |
| 2003/0052031 | A1 | * | 3/2003 | Poore | 206/448 |
| 2003/0192843 | A1 | * | 10/2003 | Winig et al. | 211/87.01 |
| 2003/0218109 | A1 | * | 11/2003 | Farnham | 248/205.1 |
| 2004/0108287 | A1 | * | 6/2004 | Winig et al. | 211/90.01 |
| 2004/0124161 | A1 | | 7/2004 | Lau | |
| 2004/0124165 | A1 | * | 7/2004 | Miller et al. | 211/153 |
| 2005/0045573 | A1 | * | 3/2005 | Winig et al. | 211/90.02 |
| 2007/0080125 | A1 | * | 4/2007 | Fratantoni | 211/85.3 |

* cited by examiner

*Primary Examiner* — Darnell Jayne
*Assistant Examiner* — Devin Barnett
(74) *Attorney, Agent, or Firm* — Brick Gentry PC; Brian J. Laurenzo

(57) ABSTRACT

A motorcycle accessory rack is provided which includes spaced-apart first and second brackets having a plurality of support rods secured thereto and extending therebetween. The first and second brackets may be secured to a supporting surface such as a wall or the like. The rods may be moved in their respective slots or openings or moved to different slots or openings to accommodate accessories from different models of motorcycles. Optional helmet hangers and jacket hangers are also provided at the sides of the rack.

30 Claims, 5 Drawing Sheets

MOTORCYCLE ACCESSORY RACK

BACKGROUND OF THE INVENTION

1. Field of the Invention

This invention relates to a motorcycle accessory rack and more particularly to a mounted motorcycle accessory wall rack having adjustable mounting points to accommodate different motorcycle accessories such as a windshield, rider backrest, passenger backrest, luggage rack or tour pack.

2. Description of the Related Art

Late model motorcycles such as Harley-Davidson have accessories for the motorcycle such as a detachable windshield, a rider backrest, a passenger backrest, a luggage rack or a tour pack, which may be detachably secured to the motorcycle or selectively removed therefrom. When the accessories are removed from the motorcycle, it is convenient to have a rack upon which the accessories may be stored. Harley-Davidson builds many different types of motorcycles and most of those models use different means or methods of mounting their detachable hardware. All of the prior art mounting racks, of which Applicant is aware, are built for only accessories from one model or family of Harley-Davidson motorcycles. For example, if a consumer has a Harley-Davidson Softail® and wall rack for those accessories and then purchases or trades that motorcycle in on a Harley-Davidson Touring model, the wall rack the consumer owned for the Softail® would not be compatible with any of the detachable accessories for the Touring model.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A motorcycle accessory rack is described which includes a first vertically disposed bracket having an inner end, an outer end, an upper end, a lower end, an inside surface and an outside surface and a second vertically disposed bracket horizontally spaced from the first bracket and which has an inner end, an outer end, an upper end, a lower end, an inside surface and an outside surface. A plurality of elongated and horizontally disposed rods having first and second ends are secured to the first and second brackets respectively and extend therebetween for supporting motorcycle accessories thereon. At least some of the rods are selectively adjustably secured to the brackets to permit the rods to be moved with respect to said brackets or to be moved to different slots or openings in the brackets to accommodate accessories from different motorcycle models. The accessory rack of this invention also includes coat hangers and helmet hangers which are removable from the rack and which may be sold as optional equipment.

It is therefore principal object of the invention to provide an improved motorcycle accessory rack.

A further object of the invention is to provide a motorcycle accessory rack which permits it to accept accessories from many different types of Harley-Davidson motorcycles.

Yet another object of the invention is to provide a motorcycle accessory rack having latching points which are adjustable to accommodate different accessories from different models of motorcycles.

A further object of the invention is to provide coat hangers and helmet hangers in association with the rack which are removable therefrom and which may be sold as optional equipment.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
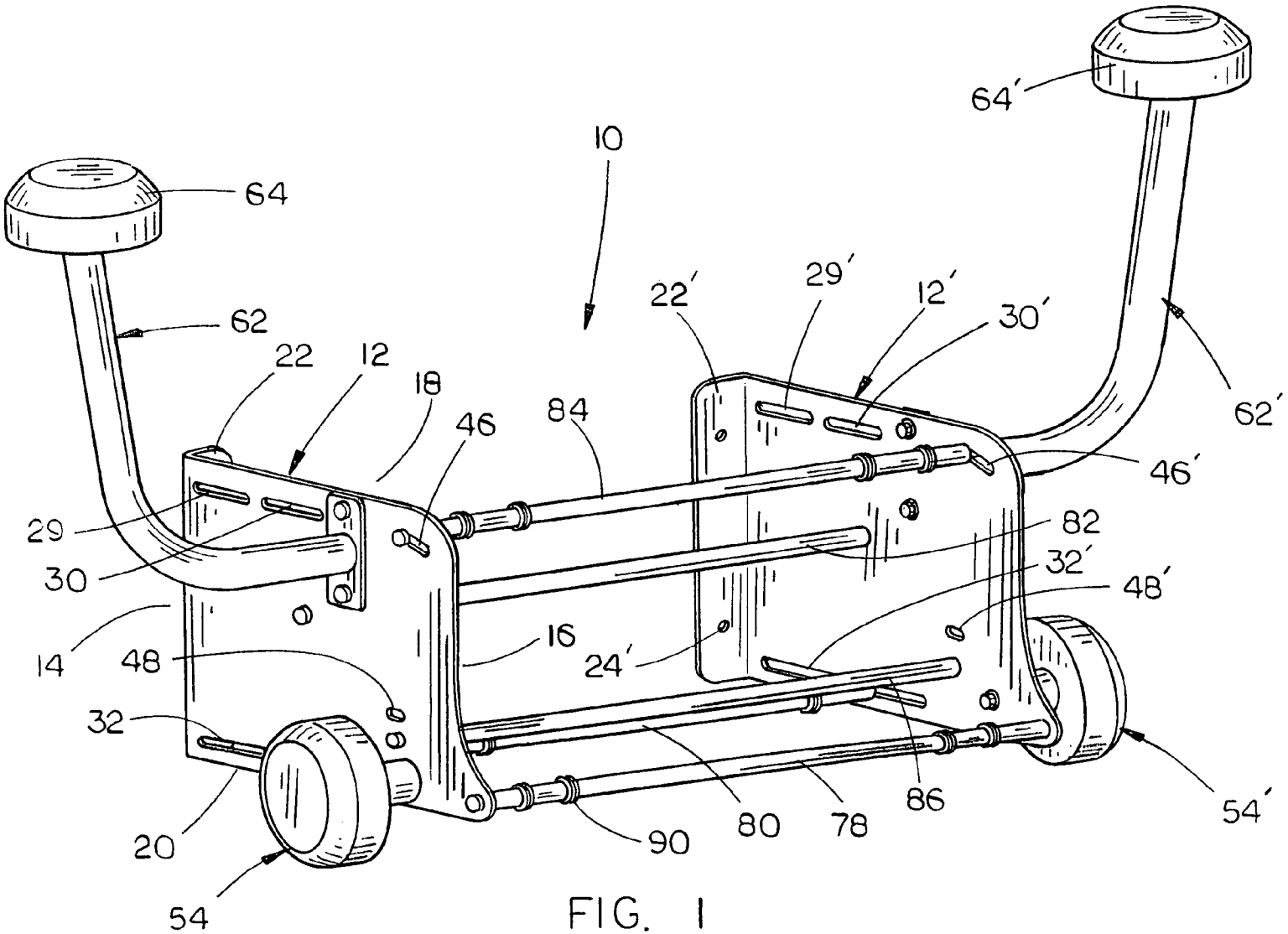
FIG. 1 is a front perspective view of the motorcycle accessory rack of this invention.
Figure 3:
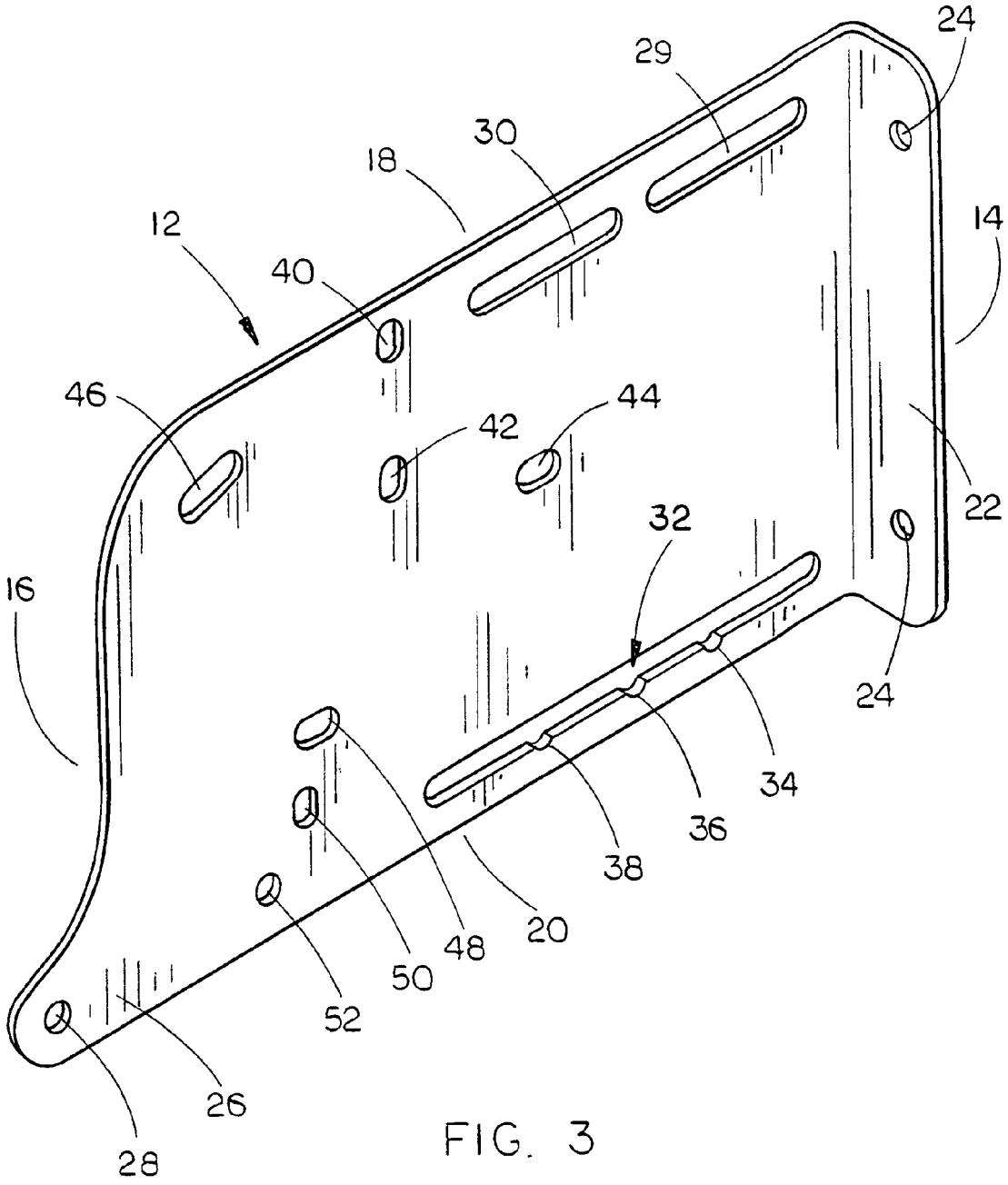
FIG. 3 is a front perspective view of one of the brackets of the rack of this invention.
Figure 4:
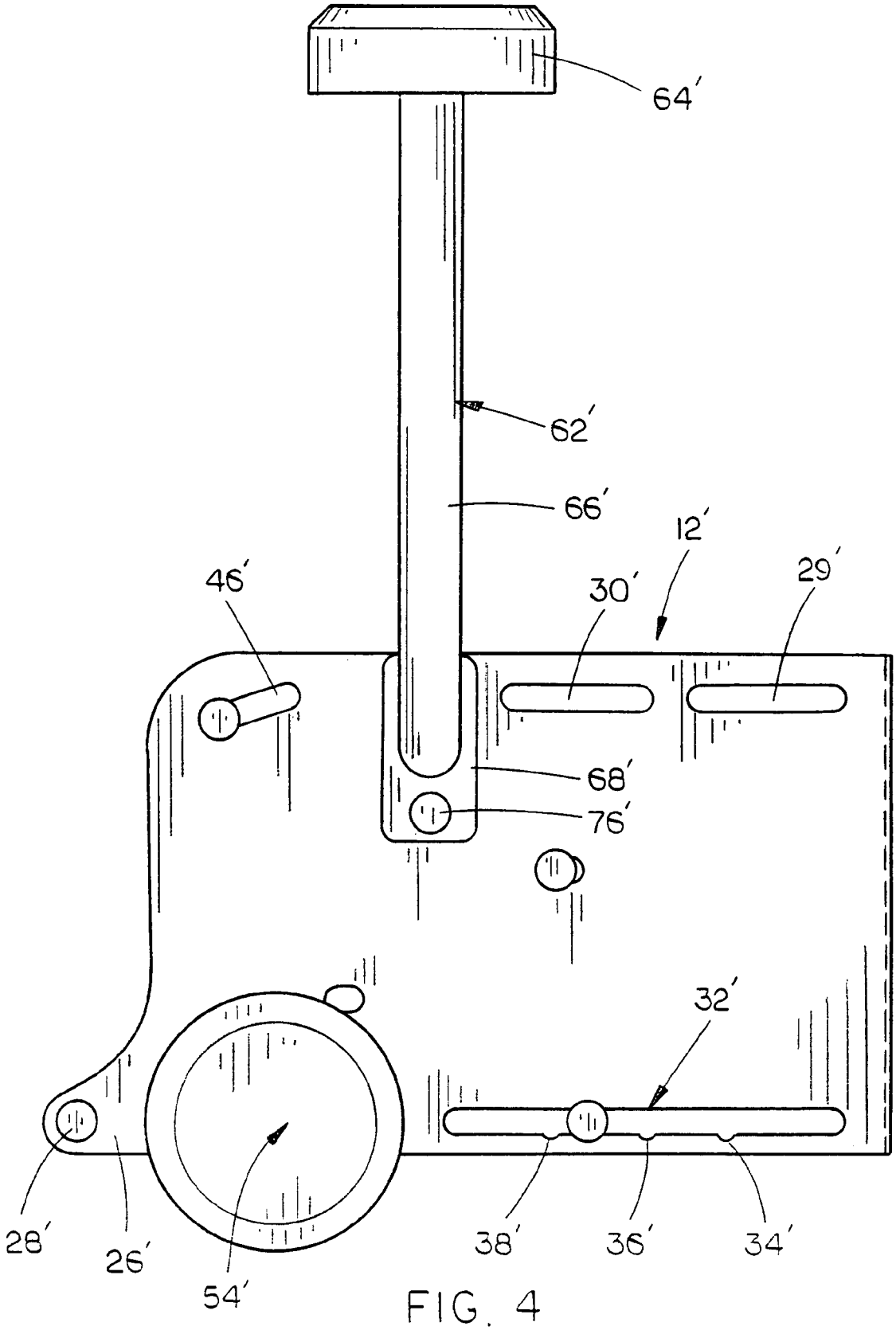
FIG. 4 is a side view of the other bracket of the rack of this invention.

The motorcycle accessory rack of this invention is referred to generally by the reference numeral 10. As seen in FIG. 1, rack 10 includes horizontally spaced-apart side brackets 12 and 12' which are mirror images of one another. Bracket 12 includes an inner end 14, an outer end 16, an upper end 18 and a lower end 20. Mounting flange 22 is provided at inner end 14 and includes a plurality of openings 24 formed therein to enable screws 25 to be inserted therethrough to secure the bracket 12 to a vertically disposed wall or the like. As seen in FIG. 3, the forward end 16 of bracket 12 includes a protruding nose portion 26 having an opening 28 formed therein. Bracket 12 includes a pair of parallel slots 29 and 30 formed therein adjacent the upper end 18 thereof. Bracket 12 also includes an elongated slot 32 formed therein adjacent the lower end 20 thereof. Slot 32 is provided with spaced-apart, semi-circular recesses 34, 36 and 38.

A pair of vertically disposed slots 40 and 42 are formed in bracket 12 outwardly of slot 30. A horizontally disposed slot 44 is also formed in bracket 12 below and inwardly of slot 42. A diagonally extending slot 46 is formed in bracket 12 outwardly of slots 40 and 42. Horizontally disposed slot 48 is formed in bracket 12 above and outwardly of slot 32. A vertically disposed slot 50 is formed in bracket 12 below the outer end of slot 48. Opening 52 is formed in bracket 12 below and outwardly of slot 50.

The numeral 54 refers to a mushroom shaped, plastic hanger holder including a threaded bolt 56 extending therefrom which is adapted to extend through opening 52 and secured therein by nut 58 so that the head portion 60 of hanger 54 is positioned laterally outwardly of bracket 12. The numeral 62 refers to another hanger including a head portion 64, support arm 66 and flat plate 68 which has openings 70 and 72 formed therein. Bolts 74 and 76 are adapted to extend through openings 70 and 72 respectively so as to extend through slots 40 and 42 respectively and be retained therein by nuts 74 and 76 respectively so as to position hanger 62 outwardly of bracket 12 as seen in the drawings.

The numerals 78, 80, 82 84 and 86 refer to elongated support rods which have internally threaded openings at each end thereof adapted to threadably receive bolts 88. At least some of the support rods have plastic or rubber grommets 90 selectively movably positioned thereon as will be described in more detail hereinafter.

Bracket 12' includes an inner end 14', an outer end 16', an upper end 18' and a lower end 20'. Mounting flange 22' is provided at inner end 14' and includes a plurality of openings 24' formed therein to enable screws 25' to be inserted therethrough to secure the bracket 12' to a vertically disposed wall or the like. As seen in FIG. 3, the forward end 16' of bracket 12' includes a protruding nose portion 26' having an opening 28' formed therein. Bracket 12' includes a pair of parallel slots 29' and 30' formed therein adjacent the upper end 18' thereof. Bracket 12' also includes an elongated slot 32' formed therein adjacent the lower end 20' thereof. Slot 32' is provided with spaced-apart, semi-circular recesses 34', 36' and 38'.

A pair of vertically disposed slots 40' and 42' are formed in bracket 12' outwardly of slot 30'. A horizontally disposed slot 44' is also formed in bracket 12' below and inwardly of slot 42'. A diagonally extending slot 46' is formed in bracket 12' outwardly of slots 40' and 42'. Horizontally disposed slot 48' is formed in bracket 12' above and outwardly of slot 32'. A vertically disposed slot 50' is formed in bracket 12' below the outer end of slot 48'. Opening 52' is formed in bracket 12' below and outwardly of slot 50'.

The numeral 54' refers to a mushroom shaped, plastic hanger or holder including a threaded bolt 56' extending therefrom which is adapted to extend through opening 52' and secured therein by nut 58' so that the head portion 60' of hanger 54' is positioned laterally outwardly of bracket 12'. The numeral 62' refers to another hanger including a head portion 64', support arm 66' and flat plate 68' which has openings 70' and 72' formed therein. Bolts 74' and 76' are adapted to extend through openings 70' and 72' respectively so as to extend through slots 40' and 42' respectively and be retained therein by nuts 74' and 76' respectively so as to position hanger 62' outwardly of bracket 12' as seen in the drawings.

The numerals 78', 80', 82' 84' and 86' refer to elongated support rods which have internally threaded openings at each end thereof adapted to threadably receive bolts 88'. At least some of the support rods have plastic or rubber grommets 90' selectively movably positioned thereon as will be described in more detail hereinafter.

Figure 2:
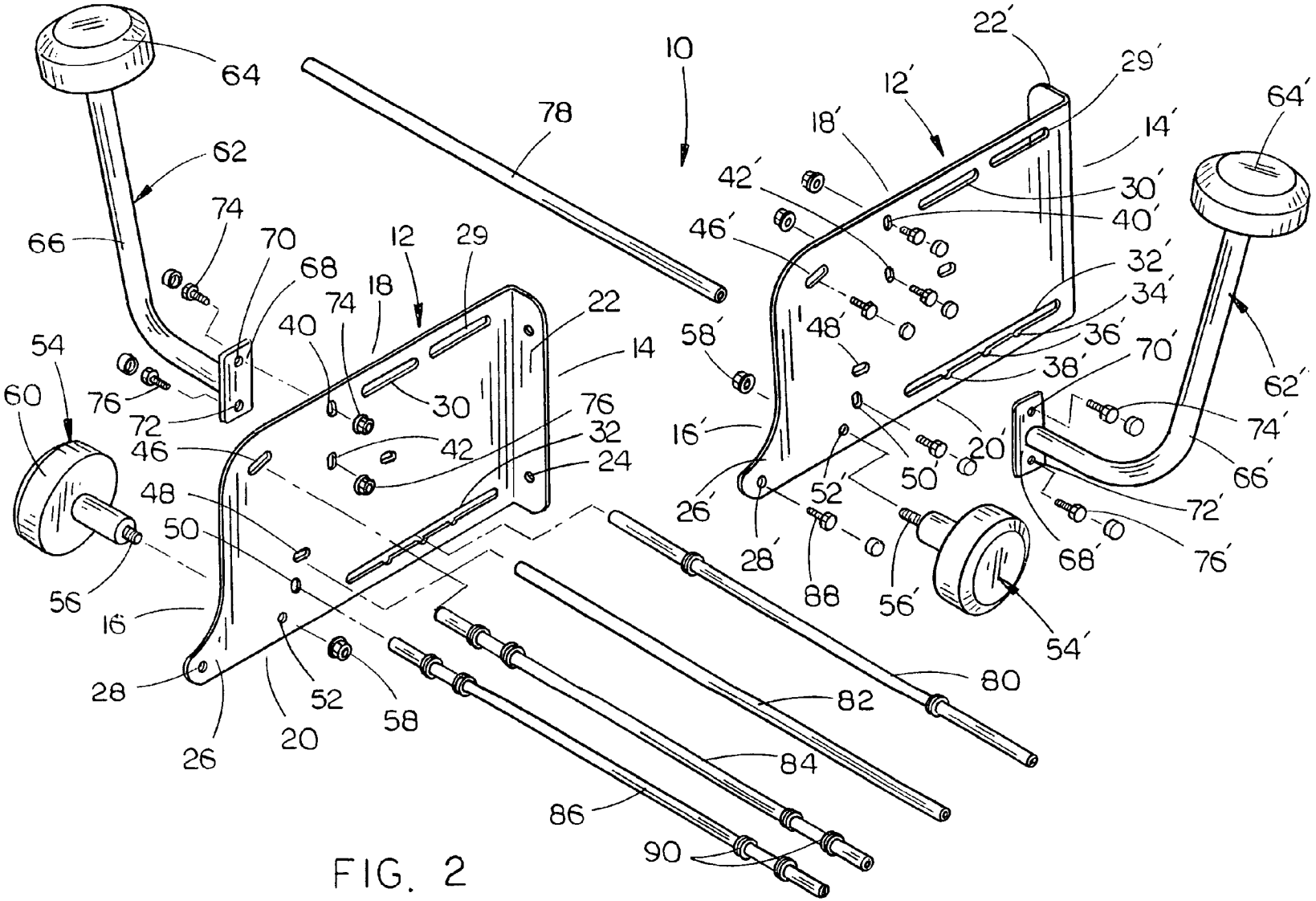
FIG. 2 is an exploded perspective view of the motorcycle accessory rack of this invention.

The rack 10 of this invention may be assembled in various different ways. In other words, the rods 84 may be selectively adjustably mounted in their slots shown in FIGS. 1 and 2 or may be moved to different slots or openings. For example, one of the rods could be inserted in slots 29 and 29' or slots 30 and 30'. Rod 86 may be inserted in the slots 48 and 48' rather than the position shown in FIG. 1. The rod 80 may be placed in any position in the slots 32 and 32' or may be inserted in their slots.

Figure 5:
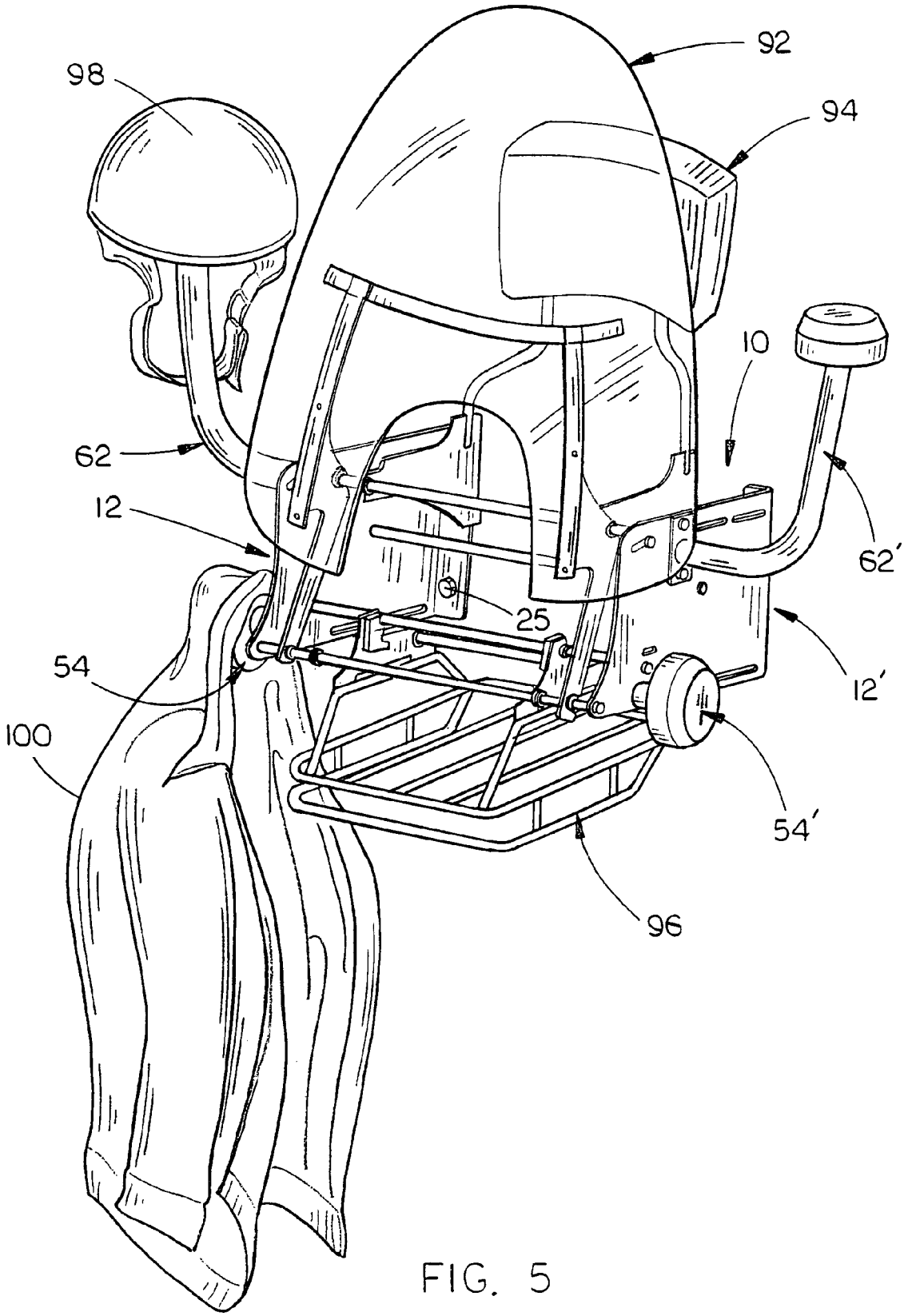
FIG. 5 is a perspective view illustrating various accessories being positioned on the accessory rack of this invention.

The fact that the rods may adjustably moved in their slots or moved to different slots or openings enables the rods to be positioned so that various motorcycle accessories may be attached thereto. For example, in FIG. 5, a detachable windshield 92 is positioned on the rack 10 as are a back rest 94, rack 96, etc. A helmet 98 may be positioned on either or both of the hangers 62 and 62' and a jacket 100 may be hung on either or both of the hangers 54 and 54'. The rack 10 may also be used to support a rider backrest, or a tour pack.

The attachment points of the accessories which enable them to be removably secured to the motorcycle are connected or secured to the various rods or grommets thereon. The adjustability of the rods permit them to be moved to a location between the brackets 12 and 12' so as to accommodate accessories from different models of motorcycles.

Thus it can be seen that the invention accomplishes at least all of its stated objectives in that it is able to accommodate accessories from different models of Harley-Davidson motorcycles. Although the invention has been described as particularly well suited for a Harley-Davidson motorcycle, it is possible it could be used for other makes of motorcycles.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A rack for storing detachable motorcycle parts in combination with said detachable motorcycle parts, comprising:
   - a first vertically disposed bracket having an inner end, an outer end, an upper end, a lower end, an inside surface and an outside surface;
   - a second vertically disposed bracket horizontally spaced from said first bracket and having an inner end, an outer end, an upper end, a lower end, an inside surface and an outside surface;
   - said inner ends of said brackets adapted to be secured to a vertically disposed wall or the like;
   - a plurality of elongated, horizontally disposed rods having first and second ends secured to said first and second brackets respectively and extending therebetween and capable of supporting detachable motorcycle parts thereon; and
   - at least some of said rods being selectively adjustably secured to said brackets permitting said rods to be selectively positioned with respect to said brackets to create latching points for said detachable motorcycle parts;
   - wherein said detachable motorcycle parts include at least two motorcycle parts selected from the group consisting of a windshield, luggage rack, backrest, and tour pack.

2. The motorcycle parts rack of claim 1, wherein at least one of said rods is selectively adjustably secured to said brackets in a horizontal plane with respect to said brackets.

3. The motorcycle parts rack of claim 1, wherein at least one of said rods is selectively adjustably secured to said brackets in a diagonal plane with respect to said brackets.

4. The motorcycle parts rack of claim 1, wherein at least one of said rods is selectively adjustably secured to said brackets in a vertical plane with respect to said brackets.

5. The motorcycle parts rack of claim 1, wherein a first hanger is secured to said first bracket so as to be positioned outwardly of said first bracket and wherein a second hanger is secured to said second bracket so as to be positioned outwardly of said second bracket.

6. The motorcycle parts rack of claim 5, wherein said first hanger extends upwardly and outwardly from said first bracket and wherein said second hanger extends upwardly and outwardly from said second bracket.

7. The motorcycle parts rack of claim 6, wherein a third hanger is secured to said first bracket so as to be positioned outwardly of said first bracket and wherein a fourth hanger is secured to said second bracket so as to be positioned outwardly of said second bracket.

8. The motorcycle parts rack of claim 1, wherein each of said brackets includes alternate slots for said rods.

9. The motorcycle parts rack of claim 1, wherein each of said brackets includes alternate openings for said rods.

10. The motorcycle parts rack of claim 1, wherein said brackets include slots or openings for receiving threaded bolts for connection to the ends of said rods.

11. The motorcycle parts rack of claim 1, wherein said brackets also include alternate slots or openings for receiving threaded bolts so that said rods may be selectively moved to alternate slots or openings.

12. A rack for storing parts detached from motorcycles in combination with at least one detachable motorcycle part, comprising:

a first vertically disposed bracket having an inner end, an outer end, an upper end, a lower end, an inside surface and an outside surface;

a second vertically disposed bracket horizontally spaced from said first bracket and having an inner end, an outer end, an upper end, a lower end, an inside surface and an outside surface;

said inner ends of said brackets adapted to be secured to a vertically disposed wall or the like;

a plurality of elongated, horizontally disposed rods having first and second ends secured to said first and second brackets respectively and extending therebetween; and at least some of said rods being selectively adjustably secured to said brackets to permit said rods to be selectively positioned with respect to said brackets to create latching points to accommodate releasable attachment of parts detached from a motorcycle and support said detached motorcycle parts thereon;

wherein said at least one detachable motorcycle part includes a plurality of attachment points which grip said rods; wherein said at least one detachable motorcycle part is selected from the group consisting of a luggage rack and backrest.

13. The motorcycle parts rack of claim 1, wherein at least one of said rods includes at least one selectively movable grommet positioned on said at least one rod to allow said at least one detachable motorcycle part to be attached thereon.

14. The motorcycle parts rack of claim 7, wherein at least one of said hangers include a head portion.

15. The rack for storing parts detached from motorcycles of claim 12, wherein the at least one detachable motorcycle part is a detachable motorcycle backrest.

16. The rack for storing parts detached from motorcycles of claim 12, wherein the at least one detachable motorcycle part is a detachable motorcycle luggage rack.

17. A motorcycle part rack, comprising:

a first vertically disposed bracket having an inner end, an outer end, an upper end, a lower end, an inside surface and an outside surface;

a second vertically disposed bracket horizontally spaced from said first bracket and having an inner end, an outer end, an upper end, a lower end, an inside surface and an outside surface;

said inner ends of said brackets adapted to be secured to a vertically disposed wall or the like;

a plurality of elongated, horizontally disposed rods having first and second ends secured to said first and second brackets respectively and extending therebetween; and at least some of said rods being selectively adjustably secured to said brackets to permit said rods to be selectively positioned with respect to said brackets to create latching points to accommodate releasable attachment of detachable motorcycle windshields, backrests, tour packs, and luggage racks;

wherein said detachable motorcycle windshields, backrests, tour packs, and luggage racks attach to said rods.

18. The rack for storing detachable motorcycle parts of claim 1 wherein said detachable motorcycle parts attach to said rack at said latching points.

19. The rack for storing detachable motorcycle parts of claim 1 wherein said detachable motorcycle parts include at least three motorcycle parts selected from the group consisting of a windshield, luggage rack, backrest, and tour pack.

20. The rack for storing detachable motorcycle parts of claim 1 wherein said detachable motorcycle parts include all of the motorcycle parts selected from the group consisting of a windshield, luggage rack, backrest, and tour pack.

21. The rack for storing detachable motorcycle parts of claim 1 wherein said detachable motorcycle parts include a windshield and a luggage rack.

22. The rack for storing detachable motorcycle parts of claim 1 wherein said detachable motorcycle parts include a windshield and a backrest.

23. The rack for storing detachable motorcycle parts of claim 1 wherein said detachable motorcycle parts include a windshield and a tour pack.

24. The rack for storing detachable motorcycle parts of claim 1 wherein said detachable motorcycle parts include a luggage rack and a backrest.

25. The rack for storing detachable motorcycle parts of claim 1 wherein said detachable motorcycle parts include a luggage rack and a tour pack.

26. The rack for storing detachable motorcycle parts of claim 1 wherein said detachable motorcycle parts include a backrest and a tour pack.

27. The rack for storing detachable motorcycle parts of claim 1 wherein said detachable motorcycle parts include a windshield, luggage rack and backrest.

28. The rack for storing detachable motorcycle parts of claim 1 wherein said detachable motorcycle parts include a windshield, luggage rack and tour pack.

29. The rack for storing detachable motorcycle parts of claim 1 wherein said detachable motorcycle parts include a luggage rack, backrest and tour pack.

30. The rack for storing detachable motorcycle parts of claim 1 wherein said detachable motorcycle parts include a windshield, backrest, and tour pack.

* * * * *